US005395113A

United States Patent [19]

Antonious

[11] Patent Number: 5,395,113

[45] Date of Patent: Mar. 7, 1995

[54] IRON TYPE GOLF CLUB WITH IMPROVED WEIGHT CONFIGURATION

[76] Inventor: Anthony J. Antonious, 7738 Calle Facil, Sarasota, Fla. 34238

[21] Appl. No.: 201,016

[22] Filed: Feb. 24, 1994

[51] Int. Cl.[6] ..... A63B 53/04

[52] U.S. Cl. ..... 273/169; 273/167 A; 273/167 F; 273/167 H

[58] Field of Search ..... 273/167 R, 167 A, 167 D, 273/167 F, 167 H, 169, 170, 171, 172, 173, 193 R, 194 R, 194 B, 77 R, 77 A; D21/214–220

[56] References Cited

U.S. PATENT DOCUMENTS

| | | | |
|---|---|---|---|
| D. 329,266 | 9/1992 | Antonious | 273/167 D |
| 3,814,437 | 6/1974 | Winquist | 273/167 H |
| 4,326,326 | 4/1982 | MacDonald | 273/167 F |
| 4,420,156 | 12/1983 | Campau | 273/77 A |
| 4,826,172 | 5/1989 | Antonious | 273/167 H |
| 5,026,056 | 6/1991 | McNally | 273/167 F |
| 5,046,733 | 9/1991 | Antonious | 273/167 H |
| 5,048,834 | 9/1991 | Gorman | 273/167 H |
| 5,082,278 | 1/1992 | Hsien | 273/167 J |
| 5,154,423 | 10/1992 | Antonious | 273/172 |
| 5,297,794 | 3/1994 | Lu | 273/167 H |

*Primary Examiner*—Sebastiano Passaniti
*Attorney, Agent, or Firm*—N. J. Aquilino

[57] ABSTRACT

An iron type golf club with an improved weight configuration including a peripheral weight extending around a rear surface of the club head body including a secondary weight system formed of a centrally located weight member located on a shelf defined by the peripheral weight directly below the center of percussion and a pair of auxiliary weight members integrally formed with and disposed on opposite sides of the centrally located weight member.

27 Claims, 3 Drawing Sheets

IRON TYPE GOLF CLUB WITH IMPROVED WEIGHT CONFIGURATION

BACKGROUND OF THE INVENTION

The present invention relates to iron type golf clubs and in particular to an iron type golf club head having a unique weight configuration.

Many conventional iron type golf clubs are structured with a peripheral weight and back cavity. These clubs have gained wide acceptance because they are more forgiving when a golf ball is struck off of the center of percussion of the club face. The peripheral mass permits mis-hit golf balls to receive more energy from the swing and therefore go farther and straighter than golf clubs without the peripheral weighting structure. However, a shortcoming of these type golf clubs is golf balls struck precisely on the center of percussion tend to feel less solid than golf clubs with an even weight distribution. To overcome this there have been many attempts at weighting of clubs within the rear cavity in order to provide all the benefits of peripheral weighting and also to maximize the performance of golf clubs when golf balls are struck directly on the center of percussion. Prior art patents of this type include my own U.S. Pat. Nos. 5,011,151, 5,046,733, 5,014,993, 4,905,386 and 4,826,172, as well as others well known in the art, including the patents to Winquist (U.S. Pat. No. 3,814,437) and McNally (U.S. Pat. No. 5,026,056), among others.

SUMMARY OF THE INVENTION

The present invention relates to a peripheral weighted cavity back iron type golf club head with a unique weight configuration. The golf club of the present invention provides a unitized weight configuration within the rear cavity formed of three distinctive weight members on the bottom ledge of the rear cavity directly under the center of percussion including a centrally disposed weight member and a pair of auxiliary weight members integrally attached on either side of the central member in a heel and toe direction. This unique concept of weight distribution produces a more responsive and more effective use of weight mass for center of percussion hits as well as off-center mishits. For example, when ball contact is made more at the toe area, the dominant central weight provides additional weight mass to minimize the adverse effect of such shots. The same is true for ball contacts made more toward the heel area. The central dominant weight member provides the additional counterbalance means to minimize or eliminate the adverse results of such heel or toe mishits. This could occur with "short" or "long" irons having the longer, heavier weight at the toe and the shorter, smaller weight at the heel. Any ball contacts made at the heel would have the benefit of having the "smaller" heel weight connected to the central dominant weight. This arrangement permits an unusual concentration of weight at the bottom portion of the rear cavity of the club head, which causes a golf ball to be hit higher and farther than a similar golf club without the improved weighting configuration of the present invention. The use of two opposing balanced weight members combined with a dominant central balancing weight member as formed in this invention provides a more effective shock absorbing mass at impact that offers more cushioning and comfort to the hands. Further, the concept minimizes or eliminates club head torquing or twisting that occurs from "thin shots" or "bladed shots" which cause erratic club face distortions. The wider spaced distribution of a unitized weight means is located precisely behind the lower portion of the club face at the critical central portion of the club head. This creates a substantially enlarged "sweet spot" area on the surface, making it more forgiving for all types of mishits that occur in the game of golf.

Since more effective ball control can be made over a larger area of the club face, a golfer can quickly develop more confidence with these clubs. This facilitates making more effective club head contact, repeatedly, which produces more solid, rewarding shots.

A number of embodiments are contemplated by the present invention by combining and precisely forming various sizes and shapes of central and secondary weights attached thereto. For example, any of the weight members may be configured so its longitudinal axis is either parallel or perpendicular to the club face. The weight members may also be configured to extend partway or all the way between the rear club head surface and the rear edge of the club head along the lower portion thereof. This more effective distribution of additional mass on the club head behind the critical area on the club face, where ball contact is most often made, produces a unitized weighting system that is more responsive and more productive to produce golf shots with optimum distance, direction and trajectory.

Among the objects of the present invention are the provision of an iron type golf club head with a unique weight configuration which permits a golfer to have all the benefits of a cavity backed peripheral weighted type golf club along with the benefits of a golf club head with more even weight distribution.

Another object of the present invention is the provision of a golf club which permits a golfer to achieve optimum transfer of potential force at impact for both center of percussion hits and off center hits, particularly when ball contact is made at the lower portion or bottom of the club head proximate the leading edge.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
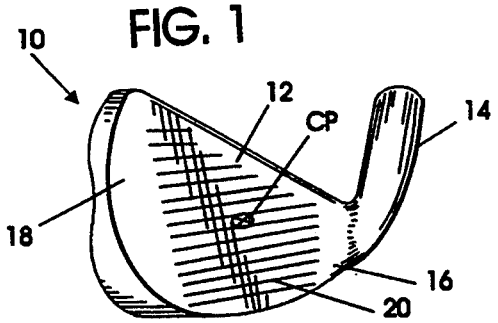
FIG. 1 shows a front perspective view of an iron type golf club head made in accordance with the present invention.
Figure 2:
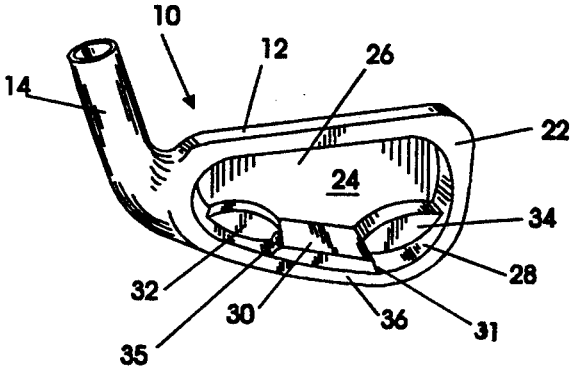
FIG. 2 is a rear perspective view of the golf club head of FIG. 1 showing the inner cavity weight configuration.

Referring to the drawings, FIGS. 1 and 2 show a typical iron type golf club head including a club head body 12, a hosel 14, heel 16, toe 18, ball striking face 20 having a center of percussion (CP) generally centrally located on the ball striking face 20. The rear of the golf club includes a peripheral weight 22 which forms a cavity 24 on the rear face 26 of the club head 10. The cavity 24 includes a lower shelf 28 which extends rearwardly from the rear surface 26 and forms the upper peripheral surface of peripheral weight 22. A secondary weight configuration is formed of a centrally disposed weight member 30 and a pair of auxiliary weight members 32 and 34 attached on either side of the central member 30 in a heel 16 and toe 18 direction. The central weight member 30 takes the form of a flat rectangular member which extends from the rear surface 26 to a rear edge 36 of the club head and lies on the shelf 28 of the peripheral weight 22 and including opposite longitudinal ends 31 and 35 facing the heel and toe, respectively. Auxiliary weight members 32 and 34 are formed adjacent the end of weight member 30 and extend in an upright direction and are formed integrally against the rear surface 26 and the club head 10. Weight members 32 and 34 are semi-hemispherical in configuration with a lower edge being integrally formed with the shelf 28, but do not extend to rear edge 36.

FIGS. 3–12 illustrate a variety of other embodiments of the present invention. It will be appreciated that these embodiments are formed on iron type golf club heads which are identical to the embodiment shown in FIGS. 1 and 2 except for the auxiliary weight configuration. That is, the irons include a club head body, heel, toe, ball striking face, hosel and of course a rear cavity and peripheral weight as seen from each of the drawings.

Figure 3:
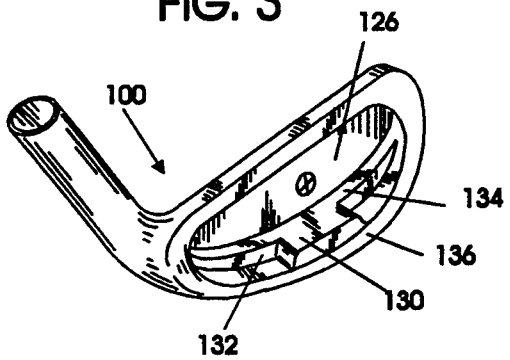
FIG. 3 illustrates a rear perspective view of a second embodiment of the present invention.

FIG. 3 illustrates a golf club head 100 including a secondary weight configuration formed of a centrally disposed weight member 130 and auxiliary weight members 132 and 134. Central weight member 130 is a generally flat rectangular member extending to the rear edge 136 from the rear surface 126 of the club head. Auxiliary weight members 132 and 134 extend in a heel to toe direction and each includes an upper surface even with the upper surface of weight member 130. As can be seen from the drawings, the auxiliary weight members 132 and 134 form wing-like appendages on either side of weight member 130.

Figure 4:
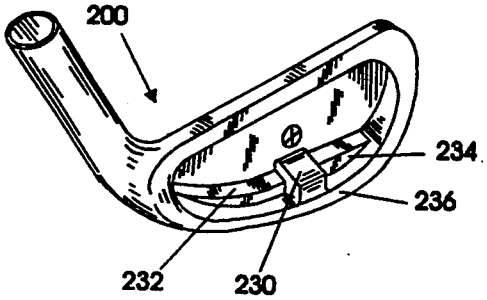
FIG. 4 illustrates a rear perspective view of a third embodiment of the present invention.

FIG. 4 illustrates a third embodiment of an iron type golf club head 200 including a secondary weight configuration formed of a central weight member 230 and auxiliary weight members 232 and 234 formed on either side thereof. In this embodiment, the central weight member 230 extends to rear edge 236 and is approximately cubic in configuration and the auxiliary members 232 and 234 form wing-like appendages on either side thereof in a heel to toe direction. Heel auxiliary member 232 is longer than toe auxiliary member 234.

Figure 5:
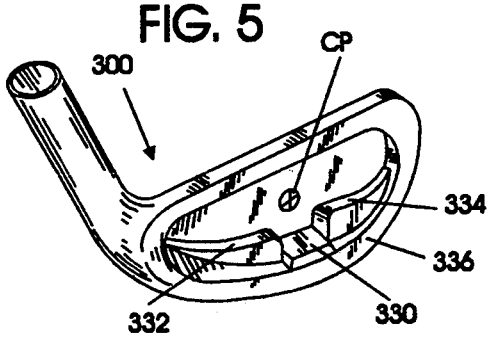
FIG. 5 illustrates a rear perspective view of a fourth embodiment of the present invention.

FIG. 5 shows a fourth embodiment of an iron type golf club head 300 including a secondary weight configuration formed of a central weight member 330 which is a flat rectangular configuration under the center of percussion (CP) and a pair of auxiliary wing-like appendages 332 and 334 formed on either side of the central member 330 in a heel to toe direction. In this embodiment, upper surfaces of the weight 332 and 334 extend beyond the upper surface of the center weight 330, but do not extend to rear edge 336.

Figure 6:
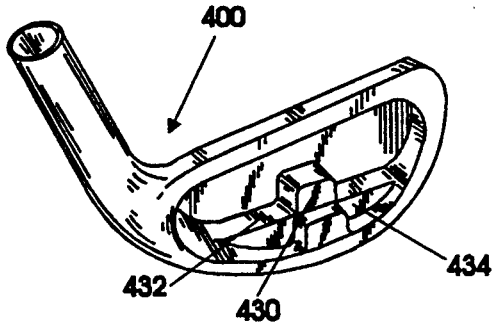
FIG. 6 illustrates a rear perspective view of a fifth embodiment of the present invention.

FIG. 6 shows a fifth embodiment of a golf club head 400 in accordance with the present invention including a secondary weight configuration formed of a central weight member 430 and auxiliary weight members 432 and 434 formed as wing-like appendages on either side thereof in a heel to toe direction. In this embodiment, the central weight member 430 is stepped which provides more weight toward the bottom of the club head.

Figure 7:
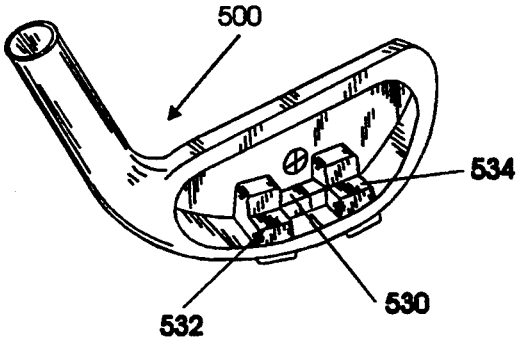
FIG. 7 illustrates a rear perspective view of a sixth embodiment of the present invention.

FIG. 7 shows a sixth embodiment of a golf club head 500 in accordance with the present invention and includes a secondary weight configuration formed of a central weight member 530 and auxiliary weight members 532 and 534 formed on either side thereof in a heel to toe configuration. In this embodiment, central member is smaller than the auxiliary weight members which are made in a step configuration.

Figure 8:
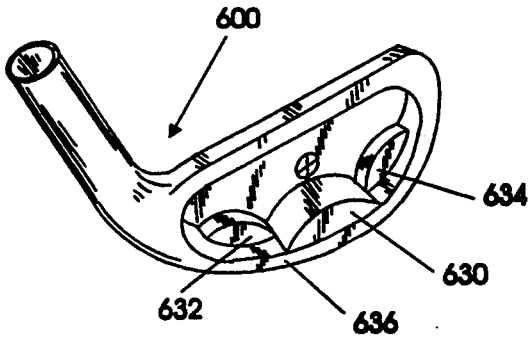
FIG. 8 illustrates a rear perspective view of a seventh embodiment of the present invention.

FIG. 8 shows a seventh embodiment of a golf club head 600 in accordance with the present invention having a secondary weight configuration including a central semi-hemispherical weight member 630 and auxiliary semi-hemispherical weight members 632 and 634 formed on either side thereof in a heel to toe direction and set back from rear edge 636.

Figure 9:
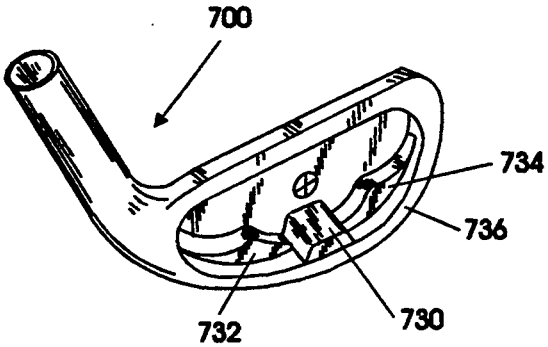
FIG. 9 illustrates a rear perspective view of a eighth embodiment of the present invention.

FIG. 9 shows an eighth embodiment of a golf club head 700 in accordance with the present invention including a secondary weight configuration formed of a centrally disposed weight member 730 and a pair of parabolic shaped auxiliary weight members 732 and 734 formed on either side thereof in a heel to toe direction set back from rear edge 736.

Figure 10:
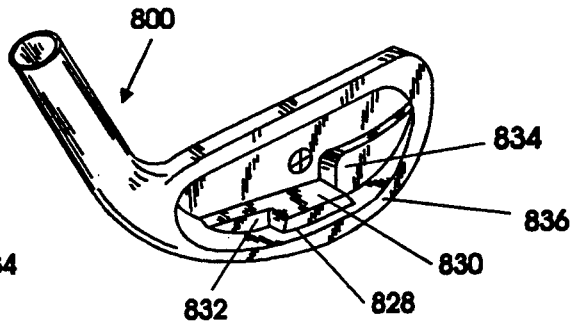
FIG. 10 illustrates a rear perspective view of a ninth embodiment of the present invention.

FIG. 10 shows a ninth embodiment of a golf club head 800 in accordance with the present invention having a secondary weight configuration formed of a central weight member 830 and a pair of auxiliary wing-like appendages 832 and 834 formed on opposite sides of the central weight member 830 in a heel to toe direction. In this embodiment, the upper surface of appendage 834 extends beyond the upper surfaces of center weight 830 and weight member 832. Toe weight member 834 is also longer and larger than heel weight member 832, both set back from rear edge 836. This embodiment provides more weight toward the toe of the club head 800 for golfers who tend to hit shots in the toe area.

Figure 11:
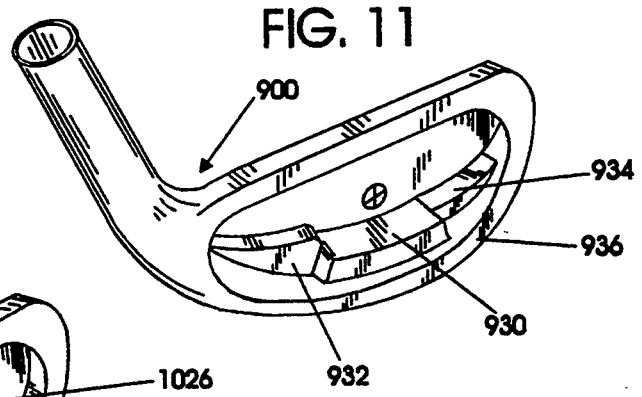
FIG. 11 illustrates a rear perspective view of a tenth embodiment of the present invention.

FIG. 11 shows a tenth embodiment of a golf club head 900 in accordance with the present invention formed of a secondary weight configuration including a centrally disposed weight member 930 and a pair of wing-like weight members 932 and 934 extending on either side thereof in a heel to toe direction and set back from rear edge 936. In this embodiment, heel weight member 932 is larger to provide more weight for golfers who hit shots in the heel area of the club head.

Figure 12:
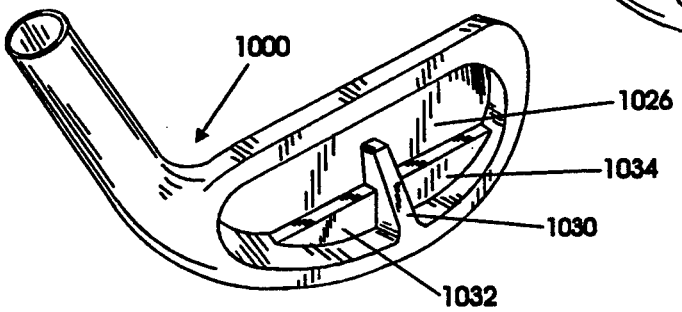
FIG. 12 illustrates a rear perspective view of a eleventh embodiment of the present invention.

FIG. 12 shows an eleventh embodiment of a golf club head 1000 in accordance with the present invention including a secondary weight configuration formed of a central weight member 1030 and a pair of auxiliary weight members 1032 and 1034 formed on opposite sides thereof. Weight member 1030 extends upwardly on the rear face of the club head 1000 toward the upper surface thereof such that at least a portion of the weight member 1030 is exactly opposite the center of percussion of the golf club.

Figure 13:
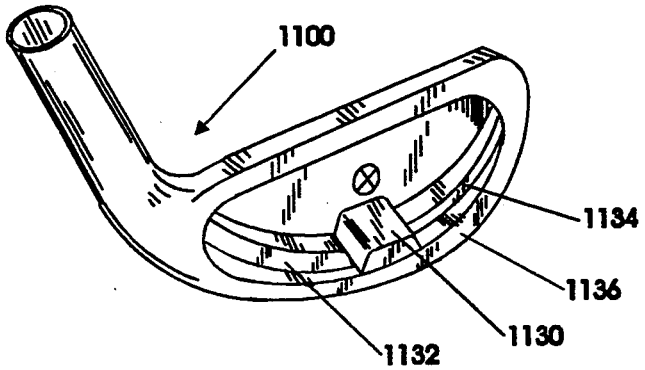
FIG. 13 illustrates a rear perspective view of a twelfth embodiment of the present invention.

FIG. 13 shows a twelfth embodiment of a golf club head 1100 in accordance with the present invention, including a secondary weight configuration formed of a central weight member 1130 and a pair of auxiliary members 1132 and 1134 which extend the entire length of a rear cavity 1124 in the heel and toe direction.

Figure 14:
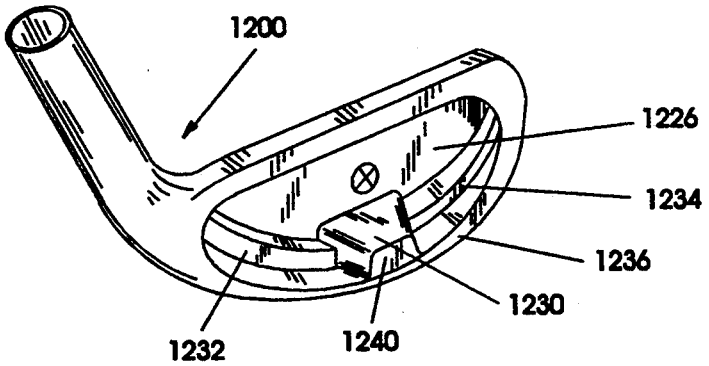
FIG. 14 illustrates a rear perspective view of a thirteenth embodiment of the present invention.

FIG. 14 shows a thirteenth embodiment of a golf club head 1200 in accordance with the present invention, including a secondary weight configuration formed of a central weight member 1230 and a pair of auxiliary weight members 1232 and 1234. Weight member 1230 is non-symmetrical and takes the form of a trapezoid having a larger base 1238 formed integrally with a rear wall surface 1226 and smaller base 1240 integral with a rear edge 1236.

It will be appreciated that all of the various weight configurations are exemplary only and that various combinations of the members shown in the various embodiments as well as other combinations and shapes of weight members may be used in keeping within the spirit and scope of the present invention as defined in the following claims.

I claim:

1. An iron type golf club head comprising:

a hosel and a club head body;

said club head body having a heel, toe, sole, ball striking face with a center of percussion thereon, a rear, central surface opposite said ball striking face, a peripheral weight extending around at least a bottom and sides of said rear, central surface, and a lower shelf which extends rearwardly from the rear, central surface to a rear edge of the peripheral weight adjacent the sole; and a secondary weight system positioned on and integrally formed with a portion of said lower shelf;

said secondary weight system being formed of three distinctive weight members, namely (i) a central weight member located in a central portion, in a heel to toe direction, of said lower shelf and having opposite longitudinal ends facing the heel and toe, respectively, and (ii) a pair of auxiliary weight members integrally connected to the respective ends of said central weight member and extending outwardly toward the heel and toe, respectively.

2. The golf club head of claim 1 wherein said central weight member and said auxiliary weight members are positioned on and integrally formed with respective portions of said central, rear surface.

3. The golf club head of claim 1 wherein said central weight member extends rearwardly along said lower shelf to a rear edge of said lower shelf and each of said auxiliary weight members extend rearwardly along said lower shelf and end at positions spaced forwardly from the rear edge of said lower shelf.

4. The golf club head of claim 1 wherein said central weight member is dominate in size, relative to each of said auxiliary weight members.

5. The golf club head of claim 1 wherein each of said auxiliary weight members are substantially the same size and shape and said central weight member is of a different size.

6. The golf club head of claim 1 wherein said auxiliary weight members respectively extend from the central weight member to, and connect with, the perimeter weight adjacent the heel and toe of said club head.

7. The golf club head of claim 1 wherein said secondary weight system is positioned on and integrally formed with a portion of said rear, central surface and said central member extends rearwardly from said rear, central surface along said lower shelf a distance which is greater than the distance each of the auxiliary weight members extends rearwardly.

8. The golf club head of claim 1 wherein said central weight member is a rectangular member which extends to a rear edge of said lower shelf.

9. The golf club head of claim 1 wherein said auxiliary weight members are semi-spherical in shape.

10. The golf club head of claim 1 wherein said auxiliary weight members are appendages extending from opposite ends of said central weight member.

11. The golf club head of claim 1 wherein said central weight member is substantially cubical in shape.

12. The golf club head of claim 1 wherein said central weight member is formed in a step configuration.

13. The golf club head of claim 1 wherein said auxiliary weight members are formed in a step configuration.

14. The golf club head of claim 1 wherein said central weight member and said auxiliary weight members are semi-spherical in shape.

15. The golf club head of claim 1 wherein said auxiliary weight members are parabolic in shape.

16. The golf club head of claim 1 wherein said central weight member extends upwardly and includes a portion directly opposite said center of percussion of said club head.

17. The golf club head of claim 1 wherein one of said auxiliary weight members has a different mass than the other auxiliary weight member.

18. The golf club head of claim 17 wherein the auxiliary weight member proximate the toe has a greater mass than the auxiliary weight member proximate the heel.

19. The golf club head of claim 17 wherein the auxiliary weight member proximate the heel has a greater mass than the auxiliary weight member proximate the toe.

20. The golf club head of claim 1 wherein said central weight member is asymmetrical in shape.

21. The golf club head of claim 1 wherein said central weight member is trapezoidal in shape.

22. An iron type golf club head comprising:

a hosel and a club head body;

said club head body having a heel, toe, sole, ball striking face with a center of percussion thereon, a rear, central surface opposite said ball striking face, a peripheral weight extending around at least the bottom and sides of said rear, central surface, and a lower shelf which extends rearwardly from the rear, central surface to a rear edge of the peripheral weight adjacent the sole; and a secondary weight system positioned on and integrally formed with a portion of said rear, central surface and a portion of said lower shelf;

said secondary weight system being formed of three distinctive weight members, namely (i) a central weight member located in a central portion, in a heel to toe direction, of said lower shelf and having opposite longitudinal ends facing the heel and toe, respectively, and (ii) a pair of auxiliary weight members integrally connected to the respective ends of said central weight member and extending outwardly toward said heel and toe, respectively.

23. The golf club head of claim 22 wherein said central weight member is dominate in size, relative to each of said auxiliary weight members.

24. The golf club head of claim 23 wherein each of said auxiliary weight members are substantially the same size and shape.

25. The golf club head of claim 23 wherein said auxiliary weight members respectively extend from the central weight member to, and connect with, the perimeter weight adjacent the heel and toe of said club head.

26. The golf club head of claim 25 wherein said central member extends rearwardly from said rear, central surface along said lower shelf a distance which is greater than the distance the auxiliary weight members extend rearwardly.

27. An iron type golf club head comprising:

a hosel and a club head body;

said club head body having a heel, toe, sole, ball striking face with a center of percussion thereon, a rear, central surface opposite said ball striking face, a peripheral weight extending around at least a bottom and sides of said rear, central surface, and a lower shelf which extends rearwardly from the rear, central surface to a rear edge of the peripheral weight adjacent the sole;

a secondary weight system positioned on and integrally formed with a portion of said rear, central surface and a portion of said lower shelf;

said secondary weight system being formed of three distinctive weight members, namely (i) a central weight member located at a central portion, in a heel to toe direction, of said lower shelf and having opposite longitudinal ends facing the heel and toe, respectively, and (ii) a pair of auxiliary weight members integrally connected to the respective ends of said central weight member, extending outwardly toward said heel and toe, respectively, and connecting with the perimeter weight adjacent the heel and toe of said club head.

* * * * *